United States Patent [19]

Gartner

[11] Patent Number: 4,474,160

[45] Date of Patent: Oct. 2, 1984

[54] FUEL INJECTION SYSTEM FOR INTERNAL COMBUSTION ENGINES

[75] Inventor: Jurij Gartner, Germering, Fed. Rep. of Germany

[73] Assignee: Bayerische Motoren Werke Aktiengesellschaft, Fed. Rep. of Germany

[21] Appl. No.: 444,447

[22] Filed: Nov. 24, 1982

[30] Foreign Application Priority Data

Nov. 26, 1981 [DE] Fed. Rep. of Germany ..... 3146889

[51] Int. Cl.[3] ..... F02M 55/02

[52] U.S. Cl. ..... 123/468; 123/470; 239/600

[58] Field of Search ..... 123/470, 471, 468, 469; 138/170, 171, 163; 285/150; 239/600

[56] References Cited

U.S. PATENT DOCUMENTS

| | | | |
|---|---|---|---|
| 45,083 | 11/1864 | Savoral | 138/171 |
| 90,322 | 5/1869 | Vanstone | 138/171 |
| 3,929,109 | 12/1975 | Chamberlain | 123/468 |
| 3,930,483 | 1/1976 | Blisko et al. | 123/470 |
| 4,286,563 | 9/1981 | Fahim et al. | 123/469 |
| 4,294,215 | 10/1981 | Hans et al. | 123/470 |
| 4,295,452 | 10/1981 | Lembke et al. | 123/469 |
| 4,300,510 | 11/1981 | Ishida et al. | 123/459 |
| 4,307,693 | 12/1981 | Glockler et al. | 123/470 |

FOREIGN PATENT DOCUMENTS

| | | | |
|---|---|---|---|
| 3014066 | 10/1981 | Fed. Rep. of Germany | 123/470 |
| 5863 | of 1897 | United Kingdom | 138/170 |

*Primary Examiner*—Magdalen Y. C. Moy
*Attorney, Agent, or Firm*—Craig & Burns

[57] ABSTRACT

A fuel injection system for internal combustion engines comprises a distributing conduit made up of two shaped parts i.e., a top section 4 and bottom section, joined together in a longitudinal plane by flanges. Several injection valves are connected to the distributing conduit by pairs of coupling bushings and coupling nipples. The flanges are integrally formed with both shaped parts of the distributing conduit at right angles to the axes of symmetry of the injection valves, and the coupling bushings are integrally formed with one of the two shaped parts in the direction of these axes of symmetry.

4 Claims, 3 Drawing Figures

FIG.1
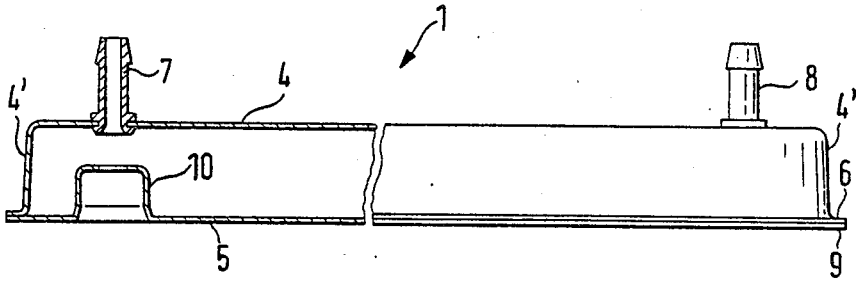
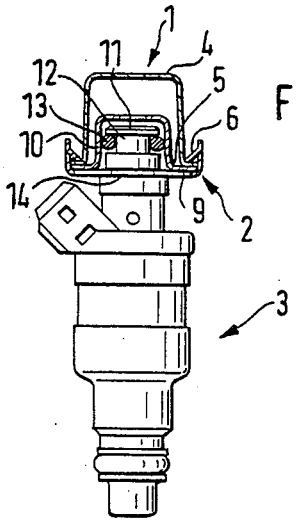
FIG. 2
FIG.3
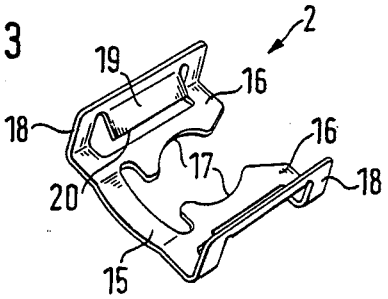

FUEL INJECTION SYSTEM FOR INTERNAL COMBUSTION ENGINES

BACKGROUND OF THE INVENTION

The invention relates to a fuel injection system for internal combustion engines having a distributing conduit, comprising two shaped parts joined by means of flanges in a longitudinal plane, and to which are connected several injection valves by means of pairs of coupling bushings and coupling nipples.

A conventional fuel injection system of this general type of structure (DOS No. 2,833,659) comprises a distributing conduit with an inner part of an elastomer with molded-on coupling bushings, this inner part being encompassed by the two shaped components. The flange plane of the shaped parts contains the axes of symmetry of the distributing conduit and of the coupling bushings so that the shaped parts represent essentially half shells of mirror-image symmetry. This construction of the distributing conduit results in a complicated and expensive fuel injection installation, since it is not only necessary to manufacture the inner part of the distributing conduit separately, but furthermore the configuration of the coupling nipples of the injection valves deviates from the customary, mass-produced shape with O-ring seal. Besides, the distributing conduit disadvantageously has a relatively heavy weight.

In another known fuel injection system (German Utility Model No. 7,918,697), a square pipe sealed at the ends is utilized as the distributing conduit, this pipe having coupling bushings soldered into bores. The injection nozzles, sealingly inserted in the coupling bushings by means of radially acting O-rings on their coupling nipples, are axially fixed in position by means of spring clips. Here again, the manufacture of the distributing conduit is complicated and expensive, since the coupling bushings must be produced separately and must be soldered into holes in the distributing conduit.

SUMMARY OF THE INVENTION

The construction of a distributing conduit from two shaped parts according to the invention simplifies manufacture since only these two parts need to be produced separately and joined together. Due to the fact that the coupling bushings are in each case formed entirely integrally with one shaped part, a reliable seal is ensured between the coupling bushings and the inserted coupling nipples of the injection nozzles, each nipple carrying a radially acting O-ring.

Further developments of the invention are characterized in that at least one shaped part, a top section, is fashioned with a hat-profile-shaped cross section, and with respectively one end wall at both ends of the distributing conduit so that this part has a trough-like configuration.

By these features, a separate sealing of the distributing conduit at the ends is avoided. Besides, the advantageous possibility is provided of shaping only one of the parts and fashioning the other part as a flat component.

The fuel injection system is further characterized in that the coupling bushings or coupling nipples extend into the hollow space of the distributing conduit. These features result in a compact, space-saving arrangement.

The fuel injection system is further characterized in that one shaped part, a bottom section, has a planar basic form and this shaped part has integrally molded therewith coupling bushings or coupling nipples.

An advantageous dispersal of the metalworking problems is thereby attained.

Moreover, the fuel injection system has injection valves which are axially fixed in place by means of spring clips, the spring clips resting against radial surfaces of the injection valves and against flanges extending over the latter. The spring clips have essentially a planar U-shape, the legs thereof lockingly cooperating with a respective injection nozzle. Each spring clip includes an axial portion integrally formed with legs at the outer edges of the latter, this portion exhibiting an inwardly pointing tang resting against the flange of the distributing conduit. These features result in a compact, reliable, and readily manipulatable attachment of the injection nozzles. In conjunction with the features described above, this construction requires an especially small amount of space.

OBJECTS OF THE INVENTION

An object of the invention is an improved fuel injection system for internal combustion engines.

A further object of the invention is an improved fuel injection system for internal combustion engines with a distributing conduit, comprising two shaped parts, i.e., a top section and a bottom section, joined by means of flanges in a longitudinal plane, and to which are connected several injection valves by means of pairs of coupling bushings and coupling nipples wherein the flanges are integrally formed with both shaped parts, i.e., the top section and bottom section, of the distributing conduit at right angles to the axes of symmetry of the injection valves and the coupling bushings and coupling nipples, respectively. The latter being integrally formed with one of the two shaped parts, the bottom section, in the direction of these axes of symmetry.

Another object of the invention is an improved fuel injection system which can be manufactured in a simple and economical fashion.

A further object of the invention is an improved fuel injection system which is lightweight.

These and other objects, features, and advantages of the present invention will become more apparent from the following description when taken in connection with the accompanying drawing which shows, for the purposes of illustration only, one embodiment in accordance with the present invention, and wherein:

BRIEF DESCRIPTION OF THE DRAWINGS

FIG. 1 shows a distributing conduit, partially in a longitudinal sectional view, for a fuel injection system for internal combustion engines, FIG. 2 is a cross section through the distributing conduit according to FIG. 1 in the region of a coupling bushing wherein an injection valve is mounted, and FIG. 3 shows a spring clip for the attachment of an injection nozzle to the distributing conduit according to FIGS. 1 and 2.

DESCRIPTION OF THE PREFERRED EMBODIMENTS

With reference to the figures wherein like reference characters represent like elements, a fuel injection system for internal combustion engines comprises a distributing conduit 1, injection valves 3 being attached to this conduit by means of spring clips 2.

The distributing conduit 1, FIG. 1, two shaped parts, a top section 4 and a bottom section 5. Both shaped parts have been manufactured from sheet metal by deep-drawing. The top section 4 is trough-shaped and has a hat-like profile in cross section. The ends of the top section 4 are sealed off by respectively an end wall 4'. A flange 6 is formed by the rims of the hat-shaped profile. A feed nipple 7 and a backflow nipple 8 are mounted by upsetting or hard soldering in the proximity of the ends of the top section 4. The feed nipple 7 and the backflow nipple 8 can also be integrally molded thereto by deep-drawing.

The bottom section 5 comprises a flange 9 and is joined to the flange 6 of the top section 4 by hard soldering. Coupling bushings 10 are integrally formed with the bottom section 5, these bushings extending into the hollow space of the distributing conduit 1.

As shown in FIG. 2, the injection nozzles 3 are inserted with their coupling nipples (sockets) 11 respectively in one of the coupling bushings 10. An O-ring 13, inserted in a peripheral groove 12 of the coupling nipple 11, effects radial sealing between the coupling nipple 11 amd the coupling bushing 10.

The spring clip 2 mounting the injection valve 3 to the distributing conduit 1 is locked, on the one hand, resiliently into an annular groove 14 of the injection valve 3 and, on the other hand, extends behind the flanges 6 and 9 of the top section 4 and bottom section 5, respectively.

The spring clips 2, FIG. 3, are of a U-shape as seen in the axial direction of the coupling bushings 10. The base 15 and the legs 16 lie essentially in one plane. The legs 16 exhibit along their inner edges mutually opposed, circular-arc-shaped, concave portions 17 with which they contact the base of the annular groove 14 of the injection valve 3 after locking into this groove. The legs 16 rest flat against the radially extending sidewalls of the annular groove 14 as seen in FIG. 2. Portions 18 are formed at the outer edges of the legs 16, these portions extending generally perpendicularly to the common plane of the base 15 and the legs 16. Each portion 18 has a tang 19 set up to point toward the axis of the coupling bushing 10, the free edge 20 of this tang engaging the flange 6.

By this configuration of the distributing conduit 1 and the spring clips 2, a simple and rapid assembly of the injection valves 3 is possible. The spring clip 2 can first be locked into the annular groove 14 of the injection valve 3 or can be locked together with the flanges 6 and 9 of the distributing conduit.

To exchange the injection valves 3, the spring clips 2 can be shifted in a direction parallel to the surfaces of the flanges 6 and 9, whereby they are released from the annular grooves 14. After the insertion of new injection valves 3, the spring clips 2 are merely shifted back into their original position.

The invention creates a lightweight distributing conduit for a fuel injection system, which conduit is easy to manufacture and wherein a rapid mounting and dismounting of the injection valves 3 is made possible by the spring clips 2. The spring clip 2 is, moreover, of a simple shape and can be easily manufactured. The distributing conduit 1 and the spring clip 2, respectively, can also be made of a fuel and temperature-resistant synthetic resin.

While I have shown and described only one embodiment in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. A fuel injection system for internal combustion engines having injection valves comprising a distributing conduit having two shaped parts joined by means of flanges in a longitudinal plane and coupling bushings and coupling nipples for connecting the injection valves, said flanges being integrally formed with the shaped parts of the distributing conduit and extending generally perpendicular to axes of symmetry of the injection valves, one of said shaped parts being fashioned with a hat-profile-shaped cross section with an end wall at each end of the distributing conduit defining a trough-like configuration, the coupling bushings and coupling nipples, respectively, being integrally formed with one of the two shaped parts in the direction of the axes of symmetry, one of the coupling bushings and coupling nipples extending into a hollow space of the distributing conduit, said injection valves being axially fixed in place relative to the distribution conduit by means of spring clips resting against radial surfaces of the injection valves and against and extending over the flanges.

2. A fuel injection system according to claim 1, wherein one shaped part has a generally planar configuration and has integrally molded therewith one of the coupling bushings and of the coupling nipples.

3. A fuel injection system according to claim 1, wherein each of the spring clips has a generally planar U-shape, the legs thereof locking cooperating with a respective injection nozzle and an axial portion of each of the spring clips being integrally formed with the legs at the outer edges of the latter, the said portion exhibiting an inwardly pointing tang for engaging against a flange of the distributing conduit.

4. A fuel injection system for internal combustion engines having injection valves comprising a distributing conduit having two shaped parts joined by means of flanges in a longitudinal plane and coupling bushings and coupling nipples for connecting the injection valves, said flanges being integrally formed with the shaped parts of the distributing conduit and extending generally perpendicular to axes of symmetry of the injection valves, the coupling bushings and coupling nipples, respectively, being integrally formed with one of the two shaped parts in the direction of the axes of symmetry, said injection valves being axially fixed in place relative to the distribution conduit by means of spring clips resting against radial surfaces of the injection valves and against and extending over the flanges, each of the spring clips having a generally planar U-shape, the legs thereof lockingly cooperating with a respective injection nozzle and an axial portion of each of the spring clips being integrally formed with the legs at the outer edges of the latter, the said portion exhibiting an inwardly pointing tang for engaging against a flange of the distribution conduit.

* * * * *